United States Patent [19]

Salvail

[11] Patent Number: 4,715,516

[45] Date of Patent: Dec. 29, 1987

[54] APPARATUS FOR DISPENSING CARBONATED BEVERAGE FROM CONTAINERS

[76] Inventor: Napoleon P. Salvail, 6610 South Fork, Titusville, Fla. 32780

[21] Appl. No.: 837,211

[22] Filed: Mar. 7, 1986

[51] Int. Cl.[4] ..... B67D 3/00

[52] U.S. Cl. ..... 222/153; 222/185; 222/481.5; 222/487; 222/509; 222/518; 222/568; 285/177

[58] Field of Search ..... 222/481.5, 483, 484, 222/487, 488, 568, 153, 185, 509, 518, 486

[56] References Cited

U.S. PATENT DOCUMENTS

| | | | |
|---|---|---|---|
| 159,054 | 1/1875 | Warker | 222/487 X |
| 803,964 | 11/1905 | Baker | 222/484 X |
| 1,017,756 | 2/1912 | Head | 222/484 |
| 1,054,146 | 2/1913 | Smirle | 222/481.5 |
| 1,140,034 | 5/1915 | Hansen | 222/487 X |
| 1,207,278 | 12/1916 | Cordley | 222/484 UX |
| 2,239,921 | 4/1941 | Majewski | 222/487 |
| 2,264,671 | 12/1941 | Kocher | 222/481.5 |
| 2,939,611 | 6/1960 | Nebinger | 222/481.5 X |
| 3,376,582 | 4/1968 | Samuels | 222/488 |
| 4,583,668 | 4/1986 | Maynard | 222/568 X |

FOREIGN PATENT DOCUMENTS

| | | | |
|---|---|---|---|
| 88678 | 6/1922 | Austria | 222/484 |
| 246452 | 1/1947 | Switzerland | 222/481.5 |

*Primary Examiner*—Joseph J. Rolla
*Assistant Examiner*—Frederick R. Handren
*Attorney, Agent, or Firm*—Macdonald J. Wiggins

[57] ABSTRACT

An apparatus for dispensing carbonated beverages and the like from a container has a body portion adapted to replace a screw top cap of the container. The body portion includes a tube which will project into the ullage volume of the container and will vent to the atmosphere via a normally closed vent valve. A normally closed fluid valve is disposed in the body portion between a fluid chamber and a spout. In use the container having the body portion attached thereto is essentially inverted and supported in a stand. A dispensing lever attached to the body is depressed and sequentially opens the vent valve and the fluid valve permitting the beverage to flow through the fluid chamber, the fluid valve and the spout by gravity.

7 Claims, 8 Drawing Figures

APPARATUS FOR DISPENSING CARBONATED BEVERAGE FROM CONTAINERS

BACKGROUND OF THE INVENTION

1. Field of the Invention

The present invention relates to an apparatus for dispensing liquids and more particularly to a dispensing valve assembly for use with pressurized and non-pressurized beverages in disposable containers.

2. Description of the Prior Art

It has become common to supply disposable beverage containers for carbonated beverages and the like which are formed from thin plastic and are available in two and three liter sizes. Once a larger container is opened, carbonation tends to be lost. In many instances, difficulty is experienced in removing and replacing the sealing cap sufficiently tightly to prevent gradual loss of carbonation during storage. These problems result in waste of beverages and reluctance of consumers to purchase the larger sizes.

Thus, there is a need for a simple, low cost dispensing system which can easily dispense carbonated beverages from large containers and will permit storage of the beverages for long periods of time without loss of carbonation.

SUMMARY OF THE INVENTION

My invention incorporates a simple dual function valve disposed in a dispensing valve assembly which is attached to the container after removal of the original cap. To draw beverage from the container, it is installed in a stand in a tilted or inverted attitude to produce a gravity feed with the dispensing valve at the lowest point. The dispensing valve includes a first passage having a vent tube projecting therefrom into the container such that the distal end of the tube projects into the ullage volume during use and a vent valve between the passage and a spout. A second passage in the valve communicates with the beverage fluid and includes a fluid valve connecting the second passage to the spout. A dispensing handle included in the valve assembly is arranged such that movement of the handle first opens the vent valve to the ullage tube and thereafter opens the fluid valve to the beverage fluid permitting fluid to flow through the spout into a glass or other desired container.

The ullage tube serves two functions. First, where escaped carbon dioxide gas has collected in the ullage volume, the ullage tube allows this gas to be vented to the outside air to prevent forceful ejection of the fluid from the spout which could cause splashing or spillage of the beverage. Secondly, the ullage tube vents makeup air to the ullage volume to prevent a thin plastic container from collapsing. When the lever is not depressed, both valves are closed and the container may be removed from the stand and stored vertically with the container in the refrigerator or other storage means without further escape of the carbon dioxide gases from the beverage.

The holder or stand with which the dispensing valve assembly is to be used includes a slot which matches the flange on the disposable beverage containers presently available and into which the container is installed. The container and dispensing valve is thereafter held rigidly in the slot, but can be easily removed for storage.

It is therefore a principal object of my invention to provide apparatus for dispensing carbonated beverages from disposable plastic containers and for permitting storage of such beverages without further loss of carbonation.

It is another object of my invention to provide a dispensing valve assembly having sequential operation of a first valve to vent the ullage volume of the container to the outside air and a second valve to dispense the liquid beverage from the container.

It is still another object of my invention to provide an apparatus for dispensing liquids which includes a stand for holding a disposable container of liquid in an inverted or slanted position to permit gravity feed of the liquid.

It is a further object of my invention to provide an apparatus for dispensing liquids which will accommodate containers of varying size.

These and other objects and advantages of my invention will become apparent from the following detailed description when read in conjunction with the drawings.

DETAILED DESCRIPTION OF THE PREFERRED EMBODIMENT

Figure 1:
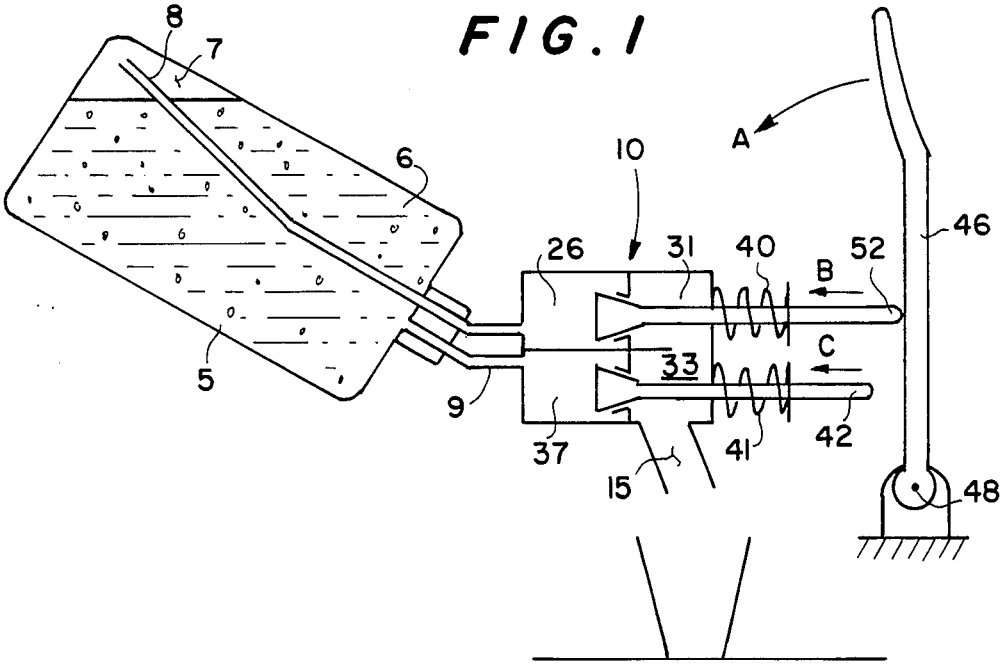
FIG. 1 is a schematic view of a dispensing valve assembly in accordance with my invention installed on a container of a carbonated beverage.

In FIG. 1, I have shown a schematic diagram illustrating the operation of my dispenser valve assembly 10. Valve assembly 10 is attached to a bottle or container of a carbonated beverage 6 in which the original container cap has been removed. A ullage vent tube 8 extends from a vent chamber 26 into the ullage volume 7 of container 5. A liquid chamber 37 is connected by a channel 9 to communicate with the liquid 6. Vent chamber 26 is maintained in a closed condition by a vent valve element 52 and compression spring 40. Similarly, fluid chamber 37 is maintained in a closed position by fluid valve element 42 and compression spring 41.

As will be understood, in the positions shown in FIG. 1, both the vent valve and fluid valve are closed and no flow of fluid will occur. An operating handle 46 is pivoted by pivot 48 such that movement of handle 46 in the direction shown by arrow A will first cause vent valve element 52 to move in the direction shown by arrow B, venting vent chamber 26 to the atmosphere via vent passage 31 and spout 15. Any carbon dioxide gas which has escaped from fluid 6 into ullage volume 7 will therefore be vented and the pressure in volume 7 will be relieved.

As handle 46 continues to move, it will contact fluid valve element 42, compressing spring 41 and opening fluid chamber 37 to the fluid passage 33. As this occurs, it will be recognized that atmospheric air is vented to ullage volume 7 permitting fluid 6 to flow by gravity through channel 9, fluid chamber 37, and out through passage 33 and spout 15 to a container. The rate of flow of the fluid can be controlled by the pressure on handle 46. When handle 46 is released, valve elements 42 and 52 will be closed by springs 40 and 41, sealing container 5 to prevent any escape of carbonation to the atmosphere.

Figure 2:
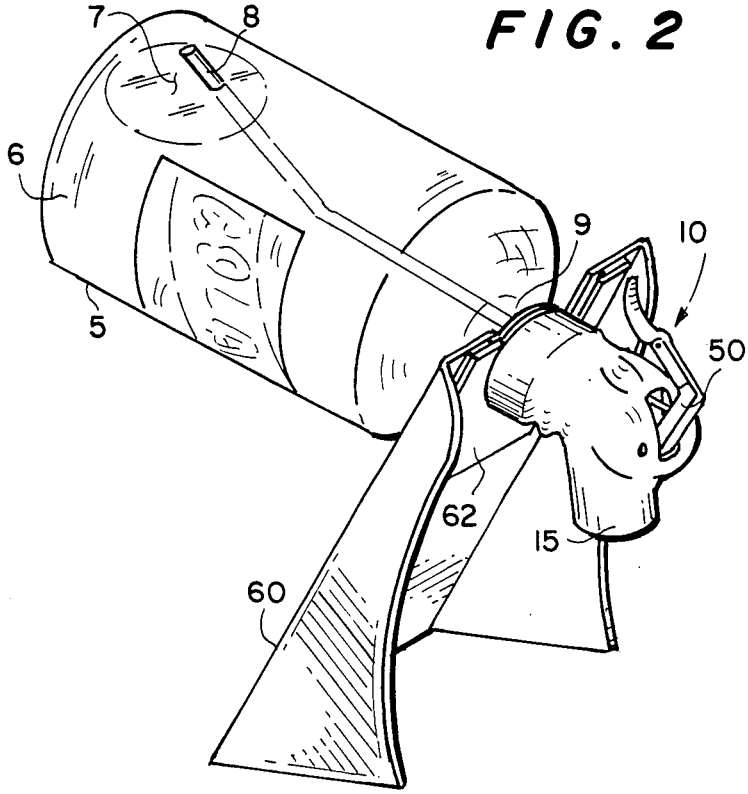
FIG. 2 is a perspective view of a typical large beverage container having the dispensing valve assembly of my invention installed thereon and the container installed on a stand.

FIG. 2 show a preferred embodiment of my invention having dispensing valve assembly 10 installed on the neck of a container 5 and installed on a stand 60 having a receiving slot assembly 62 attached thereto. Conventional containers of carbonated beverage such as container 5 are provided with heavy flange 9 between the neck and the cap threads. Advantageously, mounting slot assembly 62 permits flange 9 to be inserted therein for holding the container in place. The stand 60 is proportioned such that the center of gravity of container 5 when full is sufficiently forward such that the assembly is stable.

Figure 3:
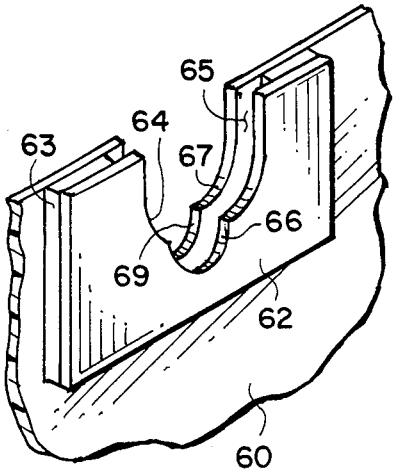
FIG. 3 is a partial view of the stand of FIG. 2 showing the container holding slots.

FIG. 3 shows a partial view of stand 60 with details of the mounting slot assembly 62. Stand 60 has a first semi-circular cutout 67 therein which matches the neck diameter of the larger disposable containers, such as container 5 of FIG. 2, and a second semi-circular cutout 69 which matches the diameter of the smaller disposable containers. A plate 62 is provided having matching cutouts 64 and 66 and is attached to stand 60 by spacer 63 thus defining a groove 65 between plate 62 and stand 60 into which flange 9 of a container will fit. As will be recognized, the smaller containers will be supported by the area formed between cutouts 66 and 69 while the larger containers will be supported by the area between cutouts 64 and 67.

Figure 4:
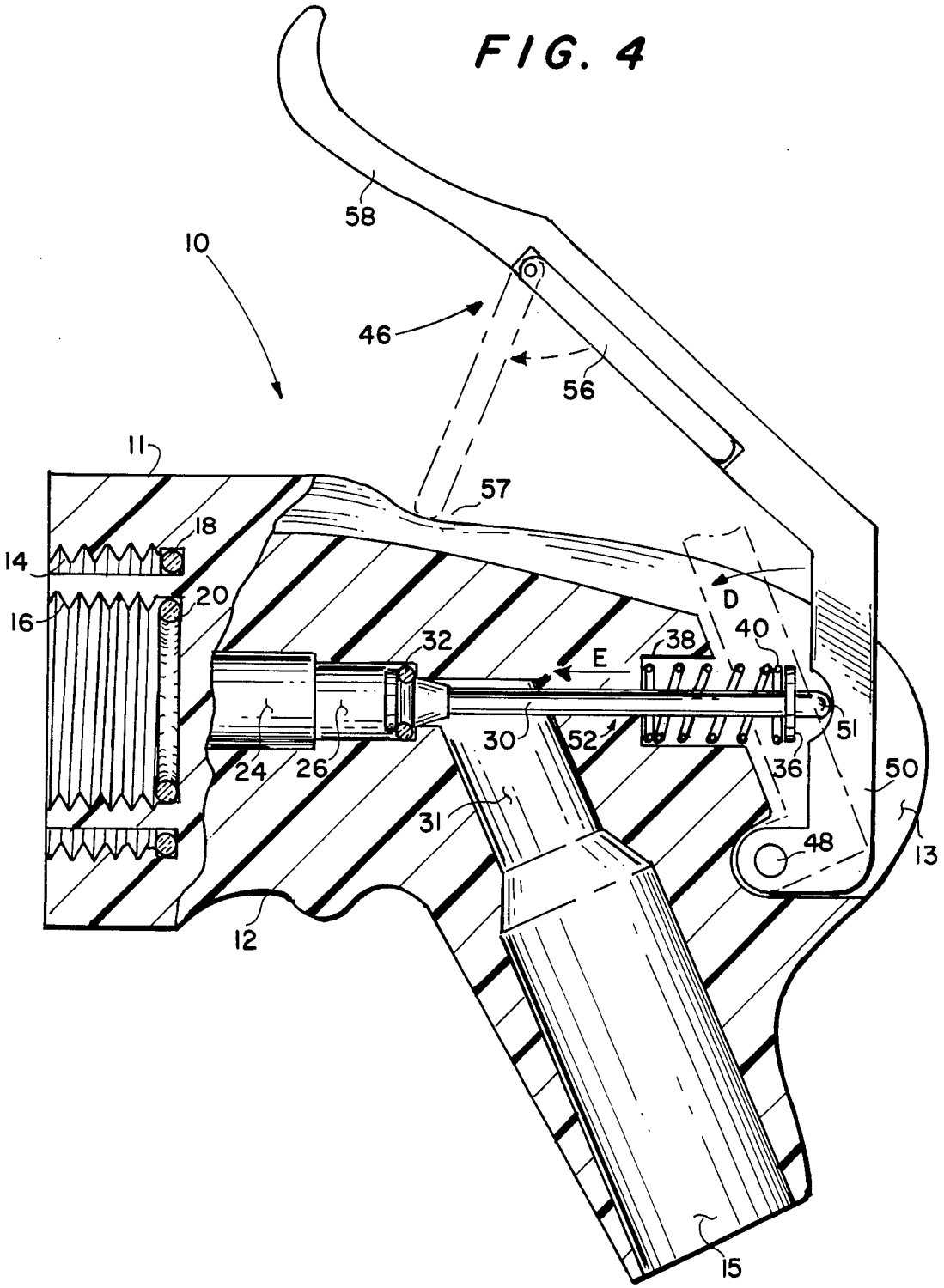
FIG. 4 is a view of the valve assembly of my invention showing the body thereof in a vertical cross-sectional view.

Turning now to FIG. 4, a cross-sectional view of the dispensing valve assembly 10 is shown. A dual thread arrangement is provided in body portion 11 having inner threads 16 and outer threads 14 for attaching assembly 10 to a container. As will be understood, threads 16 will fit the small necked bottle cap threads while threads 14 fit the large necked bottle cap threads. An O-ring 20 provides a seal for use with the small necked bottle and O-ring 18 provides the seal for the large necked bottles, as also seen from the end view of body 11 in FIG. 5.

FIG. 4 shows the vent valve arrangement having a bore 24 for receiving the ullage vent tube 8, a vent chamber 26 and a vent valve element 52 having a valve stem 30, a valve head 34 and an O-ring 32. It will be noted that valve assembly 52 includes compression spring 40 in recess 38 coupled to valve stem 30 by D-ring 36. Spring 40 is placed under tension so as to keep valve head 34 and O-ring 32 tightly closed against the shoulders of vent chamber 26. Vent chamber 26 communicates with vent passage 31 to spout 15.

Figure 5:
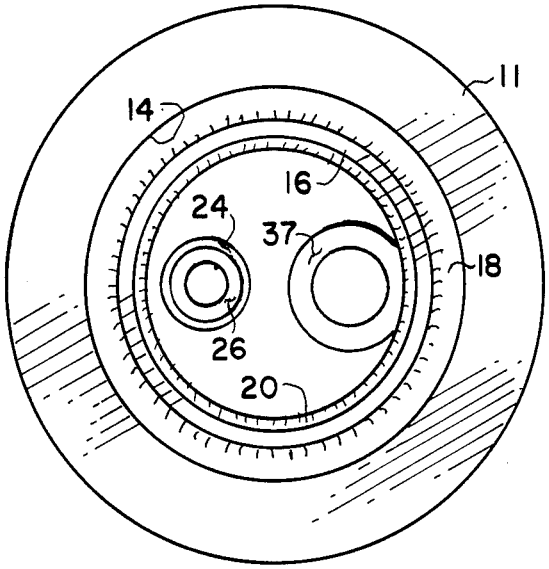
FIG. 5 is a view of the face of the coupling portion of the valve assembly of FIG. 4.
Figure 6:
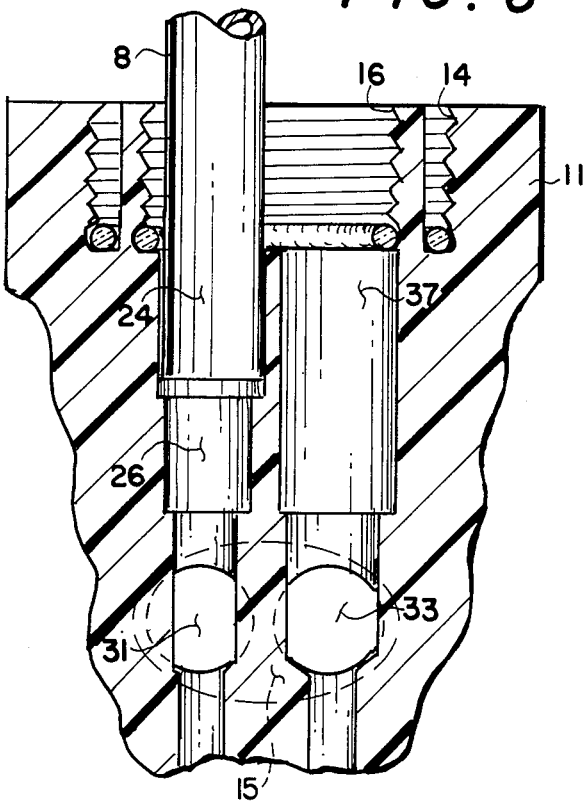
FIG. 6 is a horizontal cross-sectional view of the valve assemblies of FIG. 4.

Operating handle 46 is attached to body 11 and disposed in a slot 13 in body 11. Handle 46 is pivoted by pivot 48 and contacts the end of valve stem 30 in cutout 51. Slot 13 is formed so as to act as a stop for handle 46 in the position shown. Handle 64 includes a thumb tab portion 58 and body 11 includes a finger grip portion 12. The user may thus grasp handle 46 and body 11 with the thumb and fingers, causing handle lever 50 to move forward as indicated by arrow D moving valve stem 30 in the direction as shown by arrow E thereby opening vent chamber 26 to vent passage 31. As indicated by the dashed lines, handle lever 50 will move until it contacts the bottom of slot 13. Although not shown in FIG. 4, chambers 26 and 37 are arranged side by side horizontally as best seen in FIGS. 5 and 6. As noted in the cross-sectional view of body 11 of FIG. 6 through a horizontal plane, fluid chamber 37 is essentially parallel to chamber 26 and communicates with fluid passage 33 parallel to vent passage 31 which also connects to spout 15. As may be noted from FIG. 6, spout 15 as shown in the dashed lines is elliptical in shape while passages 31 and 33 are circular.

In FIG. 6, ullage vent tube 8 is shown installed in bore 24 and communicates with chamber 26.

Figure 7:
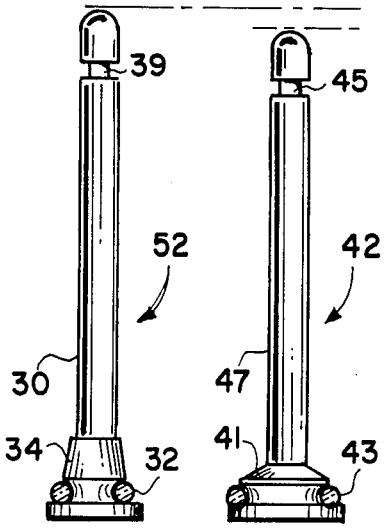
FIG. 7 shows the vent valve stem and the liquid valve stem of the invention.

Details of the vent valve element 52 and fluid valve element 42 are shown in FIG. 7. Valve 52 includes a tapered head assembly 34 with O-ring 32 disposed in a groove therein. A groove 39 is provided at the other end of valve stem 30 for accepting a spring retaining D-washer as shown in FIG. 4. As previously shown, valve head 34 is installed in vent chamber 26. Tapered head 34 of valve 52 permits the user to control the flow of gas under pressure in ullage volume 7 by the degree of pressure on valve stem 30.

Fluid valve element 42 is seen to be slightly shorter than vent valve element 52 and includes a head portion 45 having an O-ring 43 disposed thereon, a stem 42 and a groove 45 for accepting a D-washer for retaining spring 41. Head 41 is installed in fluid chamber 37 with stem 47 parallel with vent valve stem 30. Lever portion 50 of handle 46 is sufficiently wide so as to contact both valve stem 30 and valve stem 47 when handle 46 is moved in the direction shown by arrow D in FIG. 4. Since stem 47 is slightly shorter than stem 40, it will be understood that lever portion 50 will open vent valve 52 before contacting the end of liquid valve stem 47. Thus, venting or escape of pressurized gas occurs before opening of the fluid valve 42.

When handle 46 is FIG. 4 is fully depressed and in the position indicated by the dashed lines, both valves will be opened and the fluid in the attached container will flow through fluid passage 33 and spout 15 to a glass or other container. Handle 46 may be temporarily locked in the unoperated position by means of a locking arm 56 pivotally attached to handle 46. Arm 56 is shown in the retracted position in FIG. 4. When extended, as indicated by the dashed lines, arm 56 contacts a concave area 57 of body 11 thereby preventing handle 46 from being depressed.

After use of the dispensing valve assembly 10, the container with the assembly in place is removed from the stand 60 and stored with the dispensing valve assembly 10 remaining on the neck of the container, ready for subsequent use. The tightly closed valves and the cap thread O-ring prevents any loss of carbonation by leakage around a cap.

Figure 8:
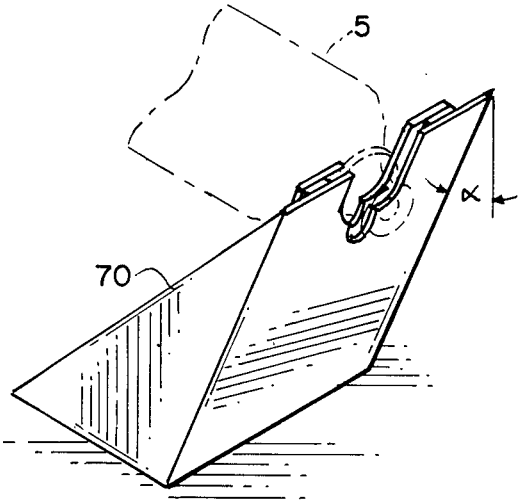
FIG. 8 shows an alternative stand for use with my dispenser valve assembly which is especially suited for use in a refrigerator.

Although I have disclosed a preferred stand 60 for holding the container and dispensing valve assembly of my invention in FIG. 2, an alternative design for a stand is shown in FIG. 8. Stand 70 may be noted to have the supporting sides thereof oppositely disposed from those of the stand of FIG. 2. The angle of the front portion of the stand 70 with the vertical shown as in FIG. 3 may be varied as desired to form a more compact arrangement which can be installed within a refrigerator yet would not require excessive space. In such instance, a beverage may be dispensed by simply opening a refrigerator door and filling a glass or other container without removing the beverage container and stand from the refrigerator.

Although I have shown specific embodiments of my invention for illustrative purposes, I consider that various changes can be made therein by those of skill in the art without departing from the spirit and scope of my invention.

I claim:

1. A beverage dispensing assembly including a container with a threaded neck and means for dispensing a liquid from said container comprising:

(a) a stand having supporting means for supporting said container such that said liquid can flow by gravity from said neck;

(b) a dispensing valve sealingly attached to said neck and having (i) a body portion;

(ii) a vent tube projecting from said body portion into the ullage volume of said container, (iii) a spout, (iv) a vent valve disposed in a passage in said body portion and having biasing means for biasing said vent valve in a normally closed position, said vent valve having an outlet communicating with said spout and an inlet, (v) said vent tube disposed in said inlet and extending through said container into and communicating with the ullage volume of said container, (vi) a fluid valve disposed in a passage communicating with the interior of said container and said spout, and having biasing means for biasing said fluid valve in a closed position, and (vii) a lever attached to said body and operatively coupled to said vent valve and to said fluid valve such that movement of said lever sequentially opens first said vent valve and then said fluid valve thereby venting said ullage volume via said spout and dispensing said liquid via said spout.

2. An apparatus for dispensing a carbonated liquid from a container having a threaded neck when said container is in an essentially inverted position comprising:

a body adapted to be sealingly attached to said neck, said body having a vent chamber and a fluid chamber, said fluid chamber communicating with liquid in said container when said body is attached to said neck;

a spout portion on said body;

a first valve means disposed in said body between said vent chamber and said spout portion, said first valve means normally closed, and having a first valve stem for opening said first valve means;

a vent tube having a first end connected to said vent chamber, said vent tube extending through said liquid to a second end within the ullage volume of said container when said body is attached to said neck;

a second valve means disposed in said body between said fluid chamber and said spout portion, said second valve means normally closed, and having a second valve stem for opening said second valve means; and an operating lever pivotally attached to said body, said lever in contact with said first valve stem and spaced apart from said second valve stem, when said first and second valve means are closed, said lever when operated first opening said first valve means for venting said ullage volume to the atmosphere via said spout portion and thereafter contacting said second valve stem for opening said second valve means for permitting said liquid to flow through said spout portion by gravity.

3. The apparatus as recited in claim 2 in which said body includes means for selectively threadably attaching said body to container necks of two different sizes.

4. The apparatus as recited in claim 2 in which each said first and second valve means includes:

a valve seat;

a valve stem;

a valve head; and biasing means for biasing each said valve head against each said valve seat.

5. The apparatus as recited in claim 4 in which the valve head of said first valve means includes a tapered portion thereof to permit control of rate of flow when said first valve means is opened.

6. The apparatus as recited in claim 4 in which said biasing means includes a first and second spring.

7. The apparatus as recited in claim 2 in which said operating lever includes means for locking said operating lever in an unoperated position.

* * * * *